US005244279A

United States Patent [19]

Law

[11] Patent Number: 5,244,279

[45] Date of Patent: Sep. 14, 1993

[54] BULK BAG

[75] Inventor: Robert B. Law, Salinas, Calif.

[73] Assignee: Ralston Purina Company, St. Louis, Mo.

[21] Appl. No.: 9,847

[22] Filed: Jan. 27, 1993

Related U.S. Application Data

[62] Division of Ser. No. 898,431, Jun. 15, 1992.

[51] Int. Cl.[5] ..... B65D 33/14

[52] U.S. Cl. ..... 383/8; 383/7; 383/24; 383/89

[58] Field of Search ..... 383/8, 24, 25, 30, 88, 383/89, 92, 7

[56] References Cited

U.S. PATENT DOCUMENTS

| | | | |
|---|---|---|---|
| 1,291,974 | 1/1919 | McNeil | 383/89 |
| 2,196,184 | 4/1940 | Belcher . | |
| 2,196,185 | 4/1940 | Belcher . | |
| 2,210,937 | 8/1940 | Geimer . | |
| 3,446,420 | 5/1969 | Rinecker | 383/89 |
| 3,962,959 | 6/1976 | Williamson . | |
| 4,113,146 | 9/1978 | Williamson . | |
| 4,143,796 | 3/1979 | Williamson et al. . | |
| 4,194,652 | 3/1980 | Williamson et al. . | |
| 4,207,937 | 6/1980 | Sandeman et al. . | |
| 4,224,970 | 9/1980 | Williamson et al. . | |
| 4,253,507 | 3/1981 | Williamson . | |
| 4,312,392 | 1/1982 | Sekiguchi . | |
| 4,340,379 | 7/1982 | Williamson . | |
| 4,493,109 | 1/1985 | Nattrass . | |
| 4,499,599 | 2/1985 | Polett et al. . | |
| 4,524,457 | 6/1985 | Marino | 383/24 X |
| 4,573,204 | 2/1986 | Polett . | |
| 4,606,570 | 8/1986 | Neumann . | |
| 4,610,028 | 9/1986 | Nattrass . | |
| 4,643,475 | 2/1987 | Neumann . | |
| 4,730,942 | 3/1988 | Fulcher . | |
| 4,742,951 | 5/1988 | Kelly et al. . | |
| 4,807,299 | 2/1989 | Nattrass et al. . | |
| 4,811,419 | 3/1989 | Derby . | |
| 4,832,506 | 5/1989 | Juel et al. . | |
| 4,865,218 | 9/1989 | Derby et al. . | |
| 4,903,859 | 2/1990 | Derby et al. . | |
| 4,909,416 | 3/1990 | Evezich . | |
| 4,917,507 | 4/1990 | Davidson . | |
| 4,925,317 | 5/1990 | Myklebust et al. . | |
| 4,944,399 | 7/1990 | Ten Bruggencate et al. . | |
| 4,991,979 | 2/1991 | Strand et al. . | |
| 5,002,400 | 3/1991 | Strand . | |

FOREIGN PATENT DOCUMENTS

| | | | |
|---|---|---|---|
| 0397552 | 11/1990 | European Pat. Off. | 383/7 |
| 1126795 | 3/1962 | Fed. Rep. of Germany . | |
| 0590187 | 1/1978 | U.S.S.R. | 383/7 |
| 1557784 | 12/1979 | United Kingdom . | |

OTHER PUBLICATIONS

Van Leer Maxemball "Flexible Intermediate Bulk Containers" No date found.

*Primary Examiner*—Allan N. Shoap
*Assistant Examiner*—Jes F. Pascua
*Attorney, Agent, or Firm*—Virgil B. Hill

[57] ABSTRACT

A flexible container or bulk bag for bulk materials such as animal feed, granular products and powdered products includes a generally tubular body defining a bottom end and a top end. A bottom seal closes the bottom of the body. Stitching or other mechanical elements seal and close the top end of the body after the container is filled with product. The body defines a single point lift at the top end of the body for transport of the filled container.

1 Claim, 5 Drawing Sheets

BULK BAG

This application is a division of copending application Ser. No. 07/898,431, filed Jun. 15, 1992.

BACKGROUND OF THE INVENTION

The present invention relates to bulk bags or containers for the transport, storage and delivery of bulk products or materials including animal feed, granular products and powdered products.

Various containers are presently available for the bulk shipment, storage and delivery of dry products or bulk materials such as animal feed, granular or powdered products. Flexible bag-like containers heretofore provided require a separate liner insert in order to seal the bulk material inside the bag after filling. Typically, the containers are finished at the point of manufacture and are shipped as completed bags. Flexible containers are also provided with lift points or loops which permit the container to be lifted and transported to or from a storage area. The lift structure may be defined by elements separate from and joined to the main body of the container. Such an approach increases the cost of manufacture. Bulk bags are generally single or one-way use containers. It is important, therefore, to minimize the cost of the containers while insuring reliability in use. Examples of prior bags may be found in U.S. Pat. No. 4,925,317 entitled FLEXIBLE CONTAINER HAVING IMPROVED LIFTING LOOPS, which issued on May 5, 1990 to Mykalebust et al and U.S. Pat. No. 4,991,979 entitled FLEXIBLE INTERMEDIATE BULK CONTAINER WITH MEANS FOR PARTLY OR COMPLETE DISCHARGE, which issued on Feb. 12, 1991 to Strand et al.

SUMMARY OF THE INVENTION

In accordance with the present invention, a relatively inexpensive and reliable, flexible bulk container or bag is provided which includes a single point lift and which does not require a separate plastic or other insert to seal the product. Essentially, the container includes a body which defines top and bottom ends. The bottom is sealed or closed at the point of manufacture. The top end of the body defines a filling point, spout or opening. After the container is filled with product, a closure seals and closes the top of the container body. Lift means are provided which are defined by the body and provide a single point lift. Opposite corners of the container may be overlapped and joined by stitching or other mechanical means, such as staples. In alternative embodiments, the corners may be looped around closure rings or a top portion of the bag may be folded downwardly on itself and joined to the bag body by stitching or other mechanical means. In each embodiment, the top end of the body defines a loop or passage providing a single point lift for the bulk container.

DETAILED DESCRIPTION OF THE PREFERRED EMBODIMENTS

Figure 1:
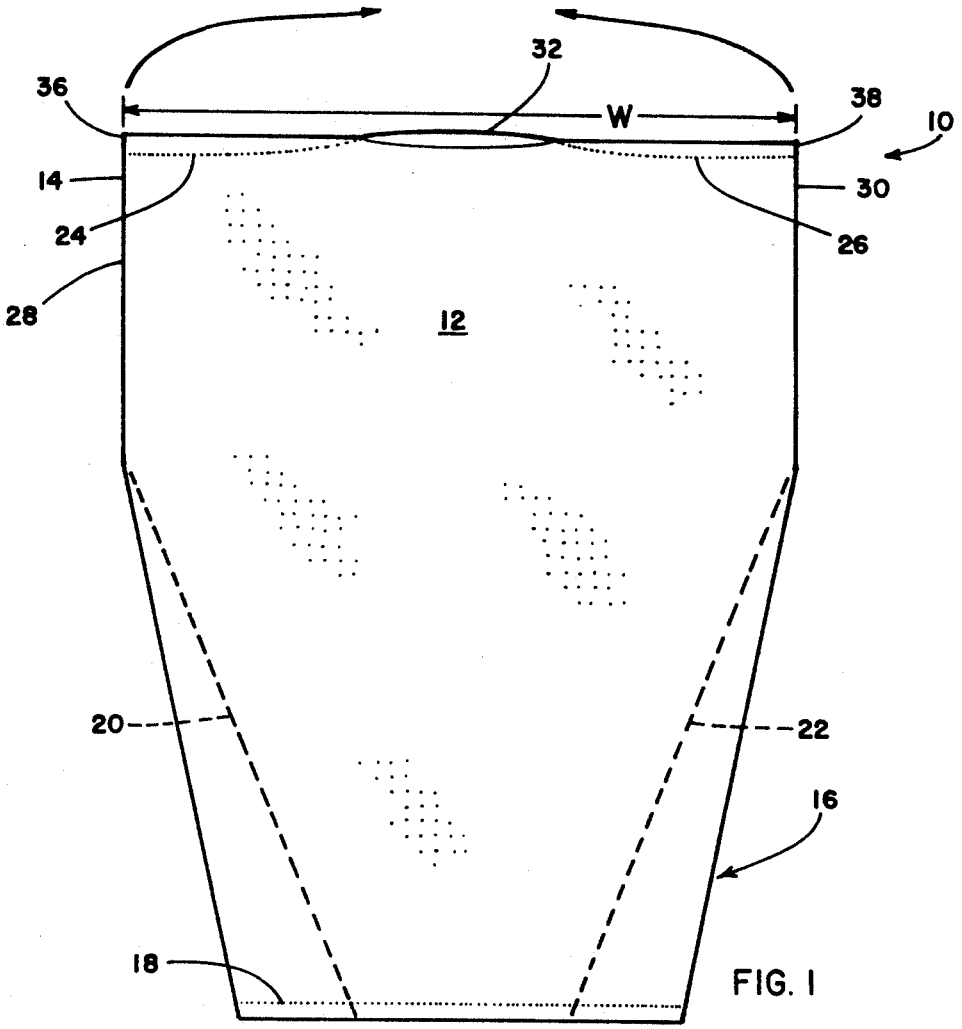
FIG. 1 is a front, elevational view of a bulk bag or container in accordance with the present invention.
Figure 2:
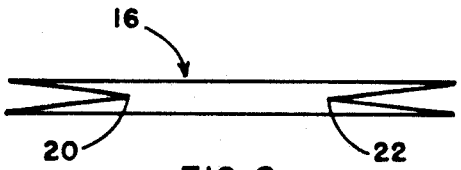
FIG. 2 is a bottom, plan view of the container of FIG. 1.

A bulk bag or flexible container in accordance with the present invention is illustrated in FIGS. 1–4 and generally designated by the numeral 10. Container 10 includes an elongated body 12 having an upper end 14 and a lower end 16. Body 12 is preferably formed into a generally tubular or sack-like configuration from a woven fabric material or partially woven synthetic material such as polypropylene. Other suitable materials may, of course, be used. Bottom end 16 of bag 10 is folded and stitched along lines 18. As shown in FIG. 2, opposite sides 20, 22 are folded inwardly to form an expandable or accordion-shaped bottom. The stitching defines a seal or closure at the bottom of the container. The top end of the container is stitched along lines 24, 26 at the point of manufacture. Such stitching extends from opposite sides 28, 30 inwardly approximately one-third of the total width "W" of top end 14 of the container. The partially finished bag, therefore, defines a central fill opening 32, which is sewn shut or otherwise mechanically closed after the bag is filled with product.

Figure 4:
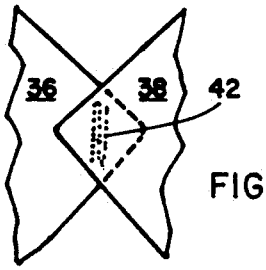
FIG. 4 is an enlarged, fragmentary view of a portion of the container of FIG. 1.
Figure 3:
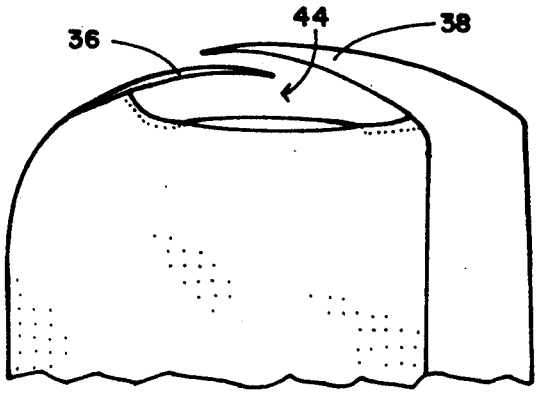
FIG. 3 is a fragmentary, perspective view of the container of FIG. 1.

As schematically shown in FIG. 1 and as illustrated in FIGS. 3 and 4, opposite corners 36, 38 are folded inwardly and overlap above the fill opening. The overlapped ends are mechanically joined by stitching 42. The overlapped corners at the stitch point, therefore, define a single point lift for the container. In effect, the overlapped corners form a passage 44 which extends between front and back sides of the container body 12. A suitable lift hook may be inserted in passage 44 for lifting and transport of the bag. Once the bag is filled with product at the bulk material plant, fill opening 32 is closed or sealed by stitching. A separate plastic insert or seal structure is not needed. The bag manufacture is not, in effect, completed until after the filling.

Figure 5:
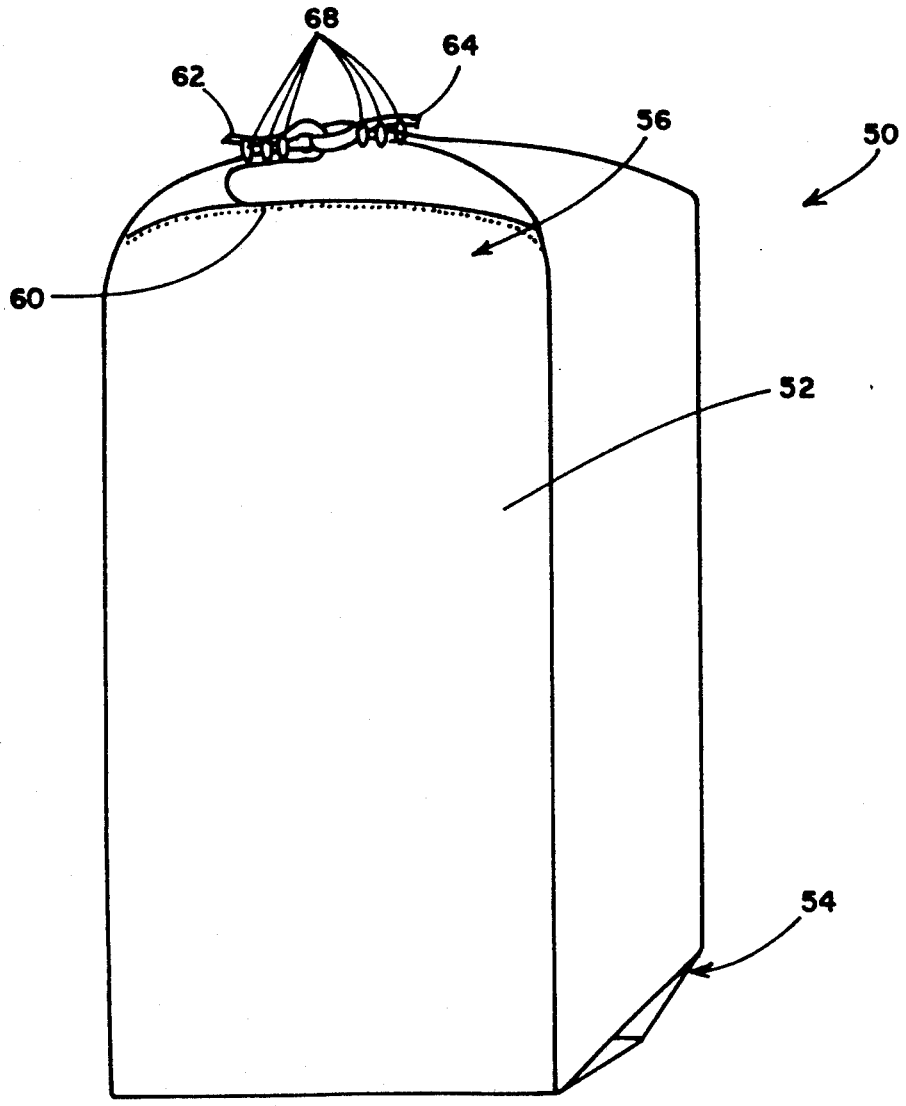
FIG. 5 is a perspective view of an alternative embodiment of the present invention.
Figure 6:
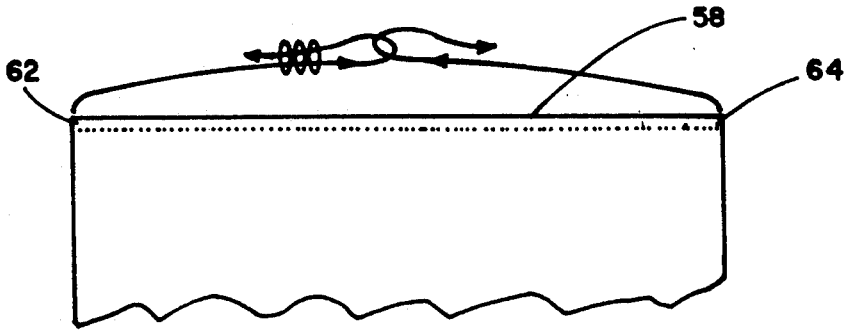
FIG. 6 is a fragmentary, front elevational view of the embodiment of FIG. 5.

An alternative embodiment of the present invention is illustrated in FIGS. 5 and 6 and generally designated by the numeral 50. Bag 50 includes a generally tubular fabric-like body 52. Body 52 includes a closed and sealed bottom 54. An upper end 56 of the body defines a fill opening 58. The fill opening is closed after the container is filled with product by stitching 60. Opposite corners 62, 64 of top end 56 of the container are folded inwardly. In this embodiment, as schematically illustrated in FIG. 6, the corners are looped through each other and folded back on each other. The corners are then joined to themselves or the bag material by mechanical closures or fasteners in the form of staples 68. The staples join the opposite corners securely and are a substitute for the stitching employed in the embodiment of FIGS. 1–4.

Figure 7:
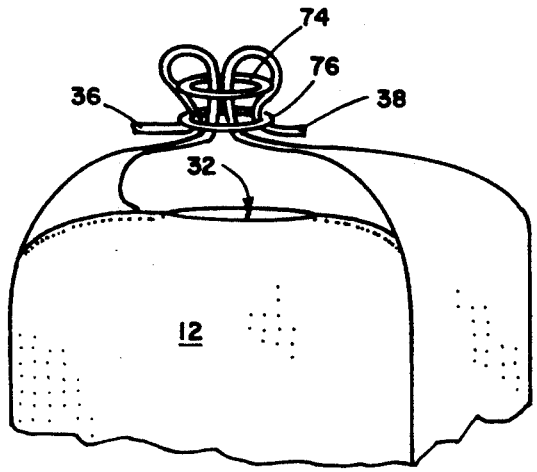
FIG. 7 is a fragmentary, perspective view of an alternative embodiment of the present invention.

FIG. 7 illustrates a still further alternative embodiment of the present invention and which is designated by the numeral 72. Embodiment 72 includes body 12 of the prior embodiments. Body 12 defines fill opening 32. A pair of circular, metal rings 74, 76 are used to join opposite corners 36, 38 in a mechanical fashion. As shown, the corners are passed or threaded upwardly in opposed relationship through the centers of rings 74, 76. The corners are then folded over the outside circumference of ring 74 and through the inside of ring 76. The corners 36, 38 are then pulled tightly outwardly and the rings 74, 76 mechanically interconnect and retain the rings at the single point lift.

Figure 8:
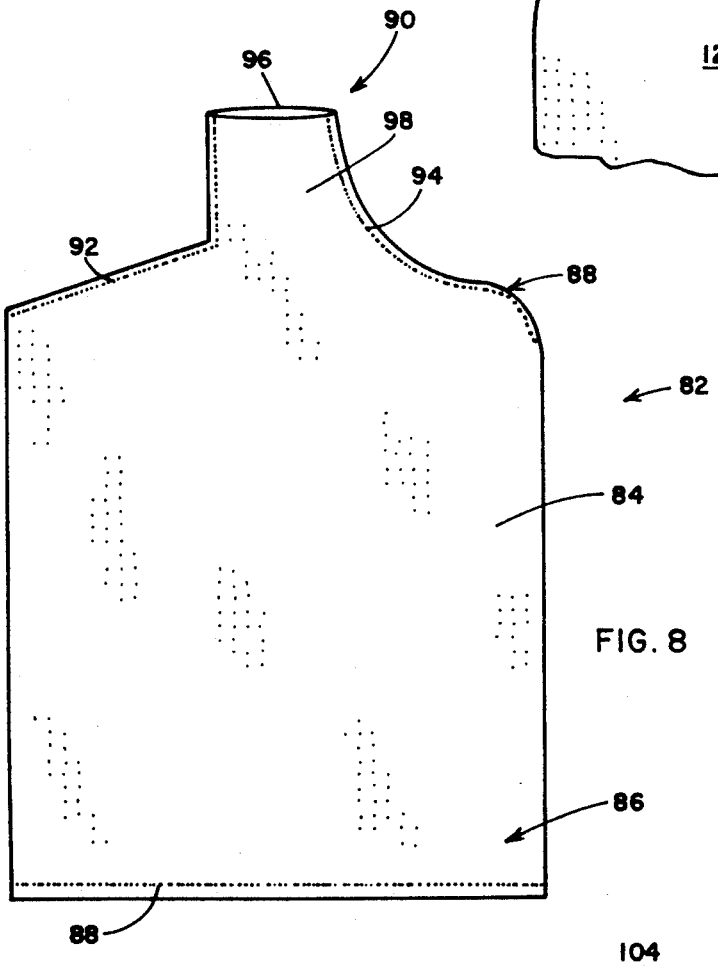
FIG. 8 is a front, elevational view of an alternative embodiment of the present invention.
Figure 9:
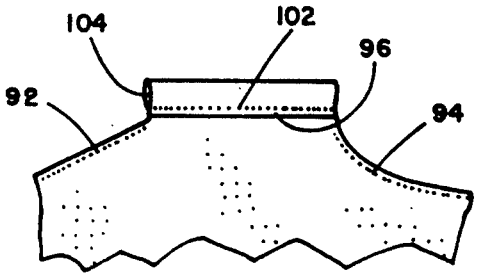
FIG. 9 is a fragmentary view of the embodiment of FIG. 8 after formation of the lift point.

FIGS. 8 and 9 illustrate a still further alternative embodiment of the present invention which is generally designated by the numeral 82. Container 82 includes a body 84 formed from a woven fabric, fabric-like material or synthetic material. A bottom end 86 is closed and sealed by stitching 88 at the point of manufacture. A top end 88 is cut to define an elongated fill spout 90. Stitching 92, 94 extends from opposite sides of body 84 up and along the fill spout. After container 82 is filled with bulk material, upper end 96 of spout 90 is folded downwardly and joined to elongated portion 98 of spout 90. Suitable stitching 102 seals and closes the fill spout. The folded over fill spout defines an elongated passage 104 dimensioned to receive a lift hook. The elongated fill spout, therefore, defines the single point lift.

Figure 10:
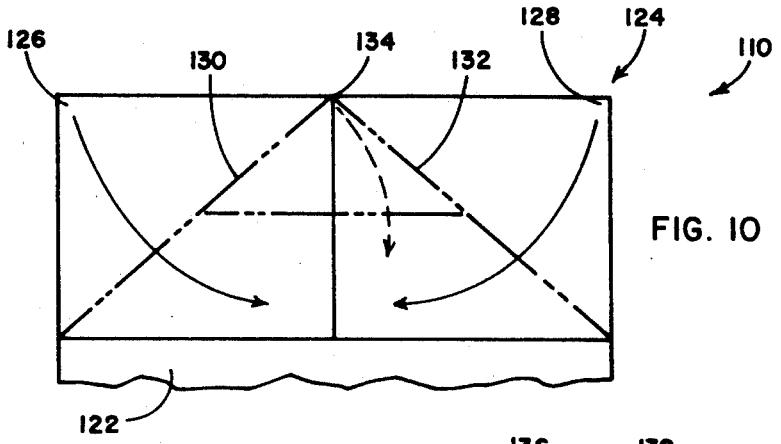
FIG. 10 is a fragmentary view of an alternative embodiment of the present invention.
Figure 11:
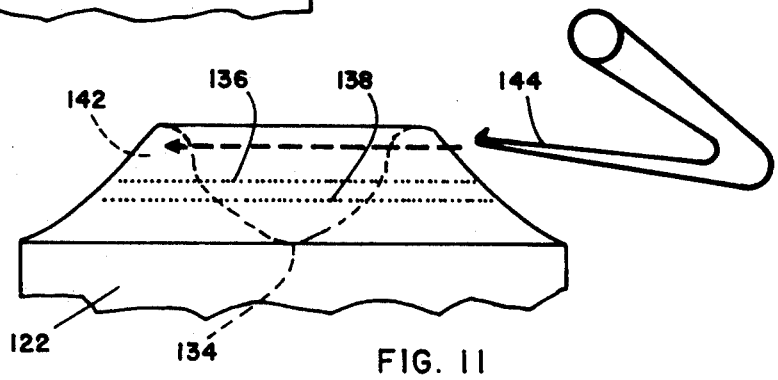
FIG. 11 is a fragmentary view of the embodiment of FIG. 10 after formation of the lift point.
Figure 12:
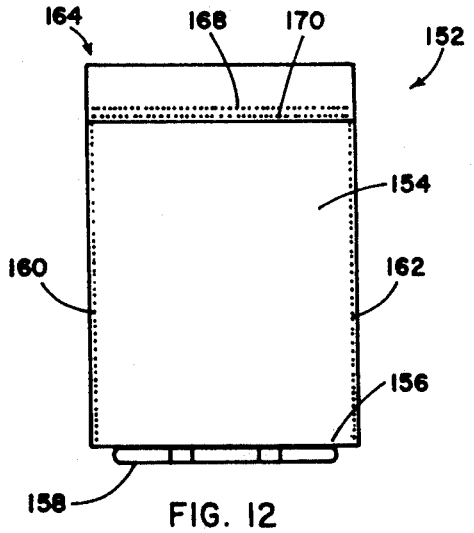
FIG. 12 is a front, elevational view of an alternative embodiment of the present invention.
Figure 13:
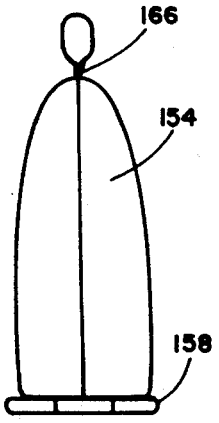
FIG. 13 is a side, elevational view of the embodiment of FIG. 12.
Figure 14:
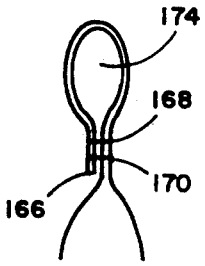
FIG. 14 is an enlarged, fragmentary, elevational view of a portion of the embodiment of FIG. 12.
Figure 15:
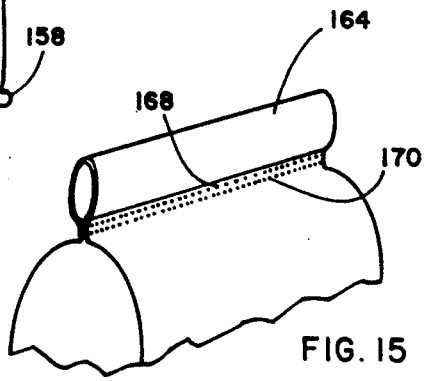
FIG. 15 is a fragmentary, perspective view of the embodiment of FIG. 12.

A still further embodiment of the present invention is illustrated in FIGS. 10 and 11 and generally designated by the numeral 120. Embodiment 120 includes a generally tubular body 122 defining an upper end 124. Upper end 124 includes opposite corners 126, 128. After the container is filled with bulk product, as shown in FIGS. 10 and 11, opposite corners 126, 128 are folded inwardly and downwardly along diagonal fold lines 130, 132. The top, therefore, is folded to a generally triangular flap configuration which includes an apex 134. As shown in FIG. 11, the apex is then folded downwardly and joined to the upper end of the container by parallel rows of stitching 136, 138. The folded over flap, therefore, defines a passage 142 dimensioned to receive a steel lift hook 144. Stitching 136, 138 seals and closes the top of the bag after it is filled. The single point lift is defined by the bag material.

A still further alternative embodiment of the present invention is illustrated in FIGS. 12–15. The embodiment, designated by the numeral 152, includes a generally tubular body 154. A lower end 156 of the body is sewn closed. Container body 154 is positioned on a suitable pallet 158. Body 154 is stitched along vertical stitch lines 160, 162. As shown, container 152 includes an upper end 164. Upper end 164 is formed by folding an initially top lateral edge 166 over and back into contact with body 154 and joining it thereto along stitch lines 168, 170. The upper end of the container, therefore, defines an elongated transverse passage 174. Passage 174 is dimensioned to receive a lift hook and defines the single point lift for the container. The stitching 168, 170 seals and closes the top end of the container after it is filled with bulk material.

Figure 16:
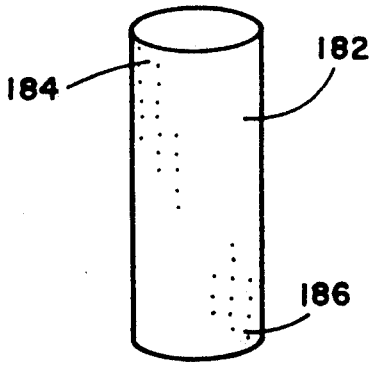
FIG. 16 is a perspective view of a tubular body used in forming an embodiment of the present invention.
Figure 17:
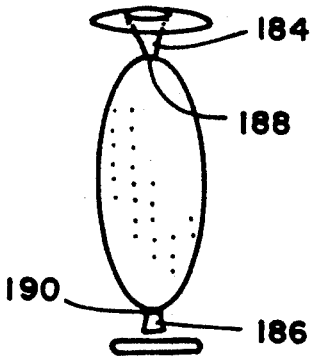
FIG. 17 is an elevational view illustrating a step in the manufacture of an embodiment of the present invention.
Figure 18:
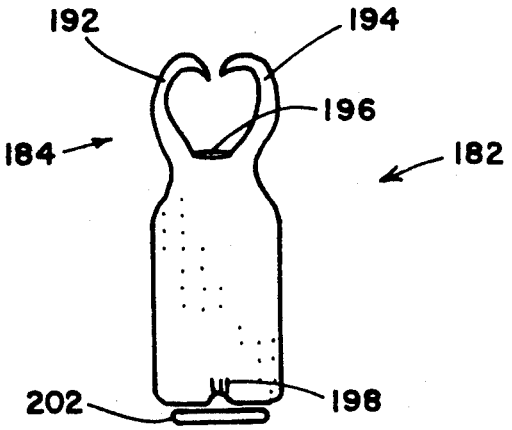
FIG. 18 is an elevational view of a partially formed container in accordance with the present invention.
Figure 19:
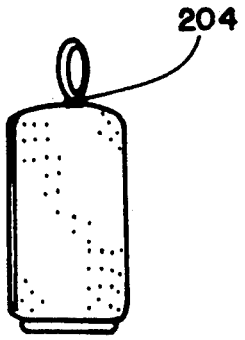
FIG. 19 is an elevational view of a still further alternative embodiment of the present invention formed in accordance with FIGS. 16, 17 and 18.
Figure 20:
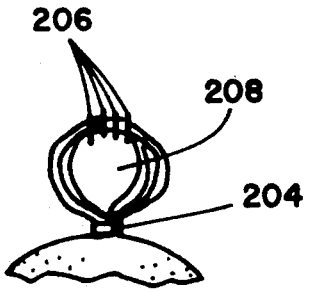
FIG. 20 is an enlarged, fragmentary view of the embodiment of FIG. 19.

FIGS. 16–20 illustrate a finished container and a method of forming same in accordance with the present invention. As shown in FIG. 16, the container is formed from a cylindrical or tubular body of fabric or synthetic material 182. Body 182 may be woven in a cylindrical or tubular form or manufactured by sewing it into the tube shape. Body 182 includes an upper portion 184 and a lower portion 186. After formation of body 182, upper portion 184 is gathered along a gathering line 188. Lower portion 186 is gathered along a gathering line 190. The excess material above gathering line 188 is then cut to form loops or tails 92, 194, as shown in FIG. 18. Upper end 184 also then defines a fill opening 196. Lower end 186 at gathering line 190 is closed or sealed by stitching or other mechanical means such as clamps or staples 198. As shown in FIG. 18, lower end 186 is inverted or folded inwardly into tubular body 182 and placed on a suitable pallet 202. After body 2 is filled with bulk product at fill opening 196, the upper end is closed or sealed at the gathering line 188. Suitable stitching or clamps 204 may be used to close the top of the bag. Loops 192, 194 are overlapped, as shown in FIG. 20, and joined by sewing or suitable staples 206. Loops or tails 192, 194, therefore, define a hook passage 208 and a single point lift for the completed container.

In each of the embodiments in accordance with the present invention, the bulk container is formed from a woven fabric or fabric-like synthetic material. Finishing of the sack or bag is accomplished after it is filled with product. A single lift point is provided at the center top of the bag. The lift point is formed by folding and joining portions of the top end of the bag. Separate loop or lift structure is not attached to form the lift point. This reduces the cost of manufacture. Stitching or staples are used to complete the manufacture of the bag, to seal the bulk material within the bag and to form the single point lift. Such steps are easily performed by the user.

In view of the above description, those of ordinary skill in the art may envision various modifications which would not depart from the inventive concepts disclosed herein. It is intended, therefore, that the above description should be considered as only that of the preferred embodiments. The true spirit and scope of the present invention may be determined by references to the appended claims.

The embodiments of the invention in which an exclusive property or privilege is claimed are defined as follows:

1. A flexible container fabricated from a fabric-like material, said container comprising:

a generally tubular body defining a bottom end and a top end;

bottom seal means for closing of the bottom end of said body, said bottom seal means including stitching on said bottom end of the body and a pallet engaging the bottom end;

closure means engaging the body for closing the top end of the body after the body is filled with product, said closure means including stitching on said top end of said body extending inwardly from sides of the body; and lift means defined by said body for providing a single point lift, said closure means and said bottom seal means sealing the container without an inner liner, the top end of the body being folded inwardly and downwardly from opposite corners to define a triangular flap and wherein said lift means includes folding said triangular flap downwardly and stitching said body across said flap to form a passage.

* * * * *